US007775839B1

(12) United States Patent
Okuyama et al.

(10) Patent No.: US 7,775,839 B1
(45) Date of Patent: Aug. 17, 2010

(54) CONNECTOR AND MANUFACTURING METHOD OF THE SAME

(75) Inventors: Takeshi Okuyama, Shinagawa (JP); Yasushi Masuda, Shinagawa (JP); Kiyoshi Sato, Shinagawa (JP); Tadashi Kumamoto, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/503,885

(22) Filed: Jul. 16, 2009

(30) Foreign Application Priority Data

Feb. 26, 2009 (JP) ..... 2009-043903

(51) Int. Cl.
*H01R 13/40* (2006.01)

(52) U.S. Cl. ..... 439/733.1

(58) Field of Classification Search ..... 439/733.1, 439/608, 108

See application file for complete search history.

(56) References Cited

U.S. PATENT DOCUMENTS

| | | | | |
|---|---|---|---|---|
| 4,762,500 | A * | 8/1988 | Dola et al. | 439/79 |
| 5,116,230 | A * | 5/1992 | Dechelette et al. | 439/101 |
| 5,160,273 | A * | 11/1992 | Carney | 439/108 |
| 5,718,592 | A * | 2/1998 | Hosler et al. | 439/63 |
| 6,129,555 | A * | 10/2000 | Daikuhara et al. | 439/60 |
| 6,540,559 | B1 * | 4/2003 | Kemmick et al. | 439/607.05 |
| 6,981,898 | B2 * | 1/2006 | Akama et al. | 439/607.09 |
| 7,458,829 | B2 * | 12/2008 | Shioda et al. | 439/108 |
| 2004/0029410 | A1 * | 2/2004 | Akama et al. | 439/65 |

FOREIGN PATENT DOCUMENTS

JP 2005-100994 4/2005

* cited by examiner

*Primary Examiner*—T C Patel
*Assistant Examiner*—Vladimir Imas
(74) *Attorney, Agent, or Firm*—IPUSA, PLLC

(57) ABSTRACT

A connector includes a plate-shaped contact; and an insulator including a fixing hole into which the contact is pressed to be fixed. At least a part of the fixing hole has a cross section in a cruciform shape.

3 Claims, 7 Drawing Sheets

CONNECTOR AND MANUFACTURING METHOD OF THE SAME

BACKGROUND OF THE INVENTION

1. Field of the Invention

The present invention generally relates to a connector and a manufacturing method thereof, and more specifically, to a balanced transmission connector and a manufacturing method thereof.

2. Description of the Related Art

Conventionally, as connector devices for electrically connecting a motherboard and a backplane, there have been known a plug connector and a jack connector. The plug connector and jack connector are provided with plural pairs of signal contacts for transmitting signals having a waveform that is symmetrical about the horizontal axis (positive negative symmetrical waveform), and with plural ground contacts arranged one by one between the adjacent pairs of signal contacts (for example, see Patent Document 1). With this configuration, crosstalk caused between the adjacent pairs of signal contacts can be prevented, and signals can be transmitted at high speed.

[Patent Document 1] Japanese Patent Application Publication No. 2005-100994

A balanced transmission connector disclosed in Patent Document 1 has an insulator for supporting the plural signal contacts and plural ground contacts to be mutually insulated from each other. The insulator includes plural fixing holes each having a linear-shaped cross section. The plural signal contacts and plural ground contacts each having a linear-shaped cross section (plate shape) are pressed to be fixed into the fixing holes. This insulator is formed by molding resin by using a mold. On a bottom surface of the mold, plural protrusions having the linear-shaped cross sections are implanted in order to mold the plural fixing holes having the linear-shaped cross sections in resin.

To arrange the plural contacts at a high density in this balanced transmission connector, the contacts are formed thin. Therefore, the protrusions used for molding the fixing holes in the resin are formed thin as well. As a result, strength of a part of the mold, which is used for molding the fixing holes in the resin, is decreased. Thus, the quality of the insulator has not been stabilized in some cases. In particular, the fixing holes for the signal contacts are smaller (normally, half or less) in size than the fixing holes for the ground contacts. Therefore, the strength of a part of the mold, which is used for molding the fixing holes for the signal contacts in the resin, is degraded.

In view of the above-described circumstances, a configuration in which each of the fixing holes for the signal contacts is formed to have a T-shaped cross section has conventionally been suggested. According to this configuration, the fixing holes for the signal contacts are molded in the resin by using protrusions having the T-shaped cross sections. Therefore, strength of a part of the mold, which is used for molding the fixing holes for the signal contacts in the resin, can be increased. Consequently, the quality of the insulator can be stabilized. Moreover, according to this configuration, there is a space between the signal contact and the ground contact. Therefore, the dielectric constant (relative dielectric constant) between the signal contact and the ground contact can be reduced. Accordingly, impedance can be increased.

In this configuration, however, the signal contacts having the linear-shaped cross sections (plate shapes) are pressed into the fixing holes for the signal contacts, which have T-shaped cross sections. Therefore, there are cases where the signal contacts are axially rotated and thus the distance between the signal contact and the ground contact is changed. Accordingly, there have been cases where the impedance is changed and the impedance match is degraded.

SUMMARY OF THE INVENTION

The present invention has been made in view of the above-described problems, and it is an object of at least one embodiment of the present invention to provide a connector which has a configuration capable of stabilizing the quality of an insulator and which can maintain impedance match, and to provide a manufacturing method of the connector.

According to one aspect of the present invention, a connector includes a plate-shaped contact; and an insulator including a fixing hole into which the contact is pressed to be fixed. At least a part of the fixing hole has a cross section in a cruciform shape.

According to another aspect of the present invention, a manufacturing method of a connector is provided. The method includes a step of molding an insulator with resin by using a mold having a bottom surface on which a protrusion is provided, in which at least a part of the protrusion has a cross section in a cruciform shape, and a step of pressing a plate-shaped contact to be fixed into a fixing hole formed by the protrusion.

According to another aspect of the present invention, a balanced transmission connector includes an insulator formed of resin and having plural fixing holes arranged in a line; plural plate-shaped metal signal contacts; and plural plate-shaped metal ground contacts. The plural plate-shaped metal signal contacts and the plural plate-shaped metal ground contacts are pressed to be fixed into the plural fixing holes of the insulator so as to be alternately arranged with each other. Each of the plural fixing holes in which the plural plate-shaped metal signal contacts are fixed has at least a part having a cross section in a cruciform shape.

BRIEF DESCRIPTION OF THE DRAWINGS

(FIG. 6B is prior art) where a signal contact is pressed to be fixed into a fixing hole for the signal contact.

DETAILED DESCRIPTION OF THE PREFERRED EMBODIMENTS

A preferred embodiment of the present invention is described below with reference to the drawings.

Figure 1:
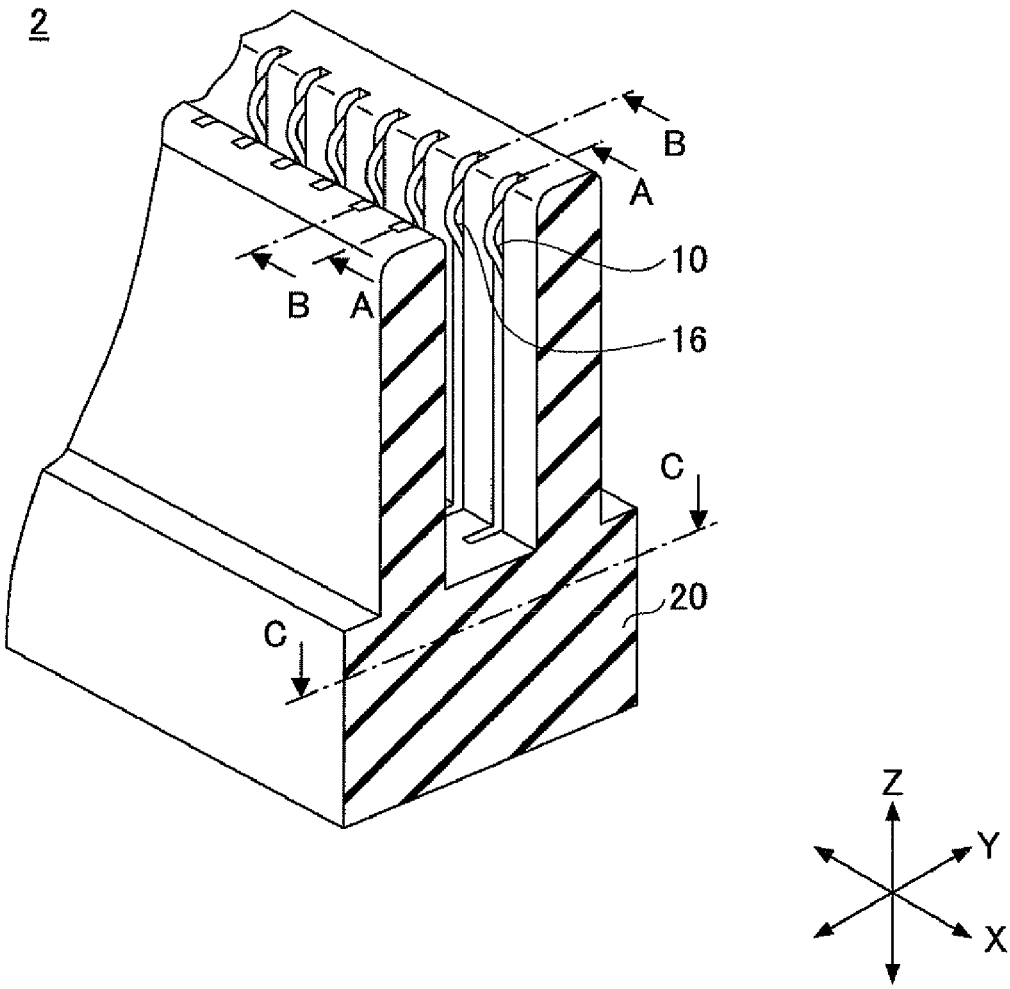
FIG. 1 is a perspective view showing an embodiment of a balanced transmission connector 2 of the present invention.
Figure 2:
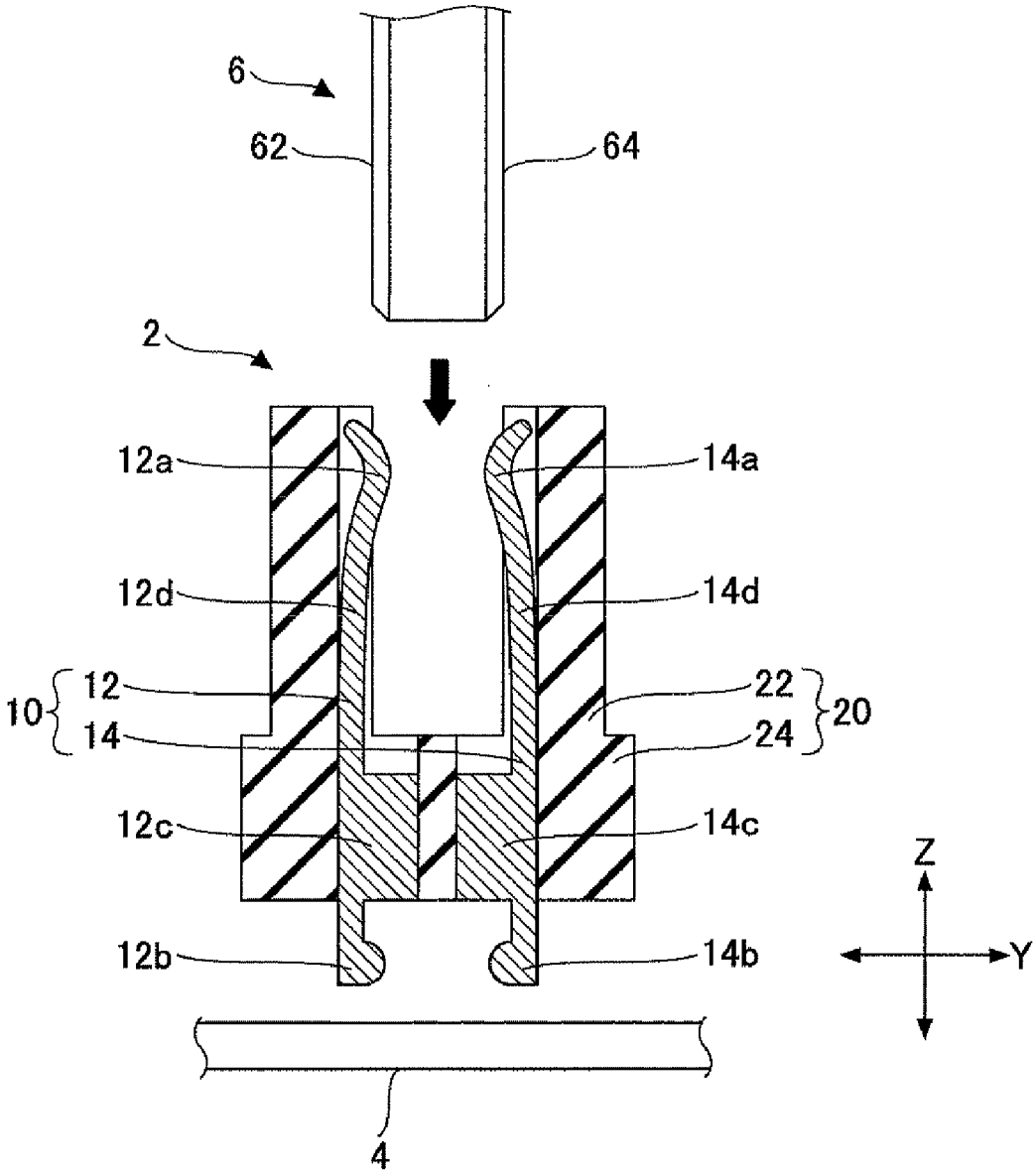
FIG. 2 is a cross-sectional view on arrows A-A, showing a connection mode between the balanced transmission connector 2 and a counterpart connector 6.
Figure 3:
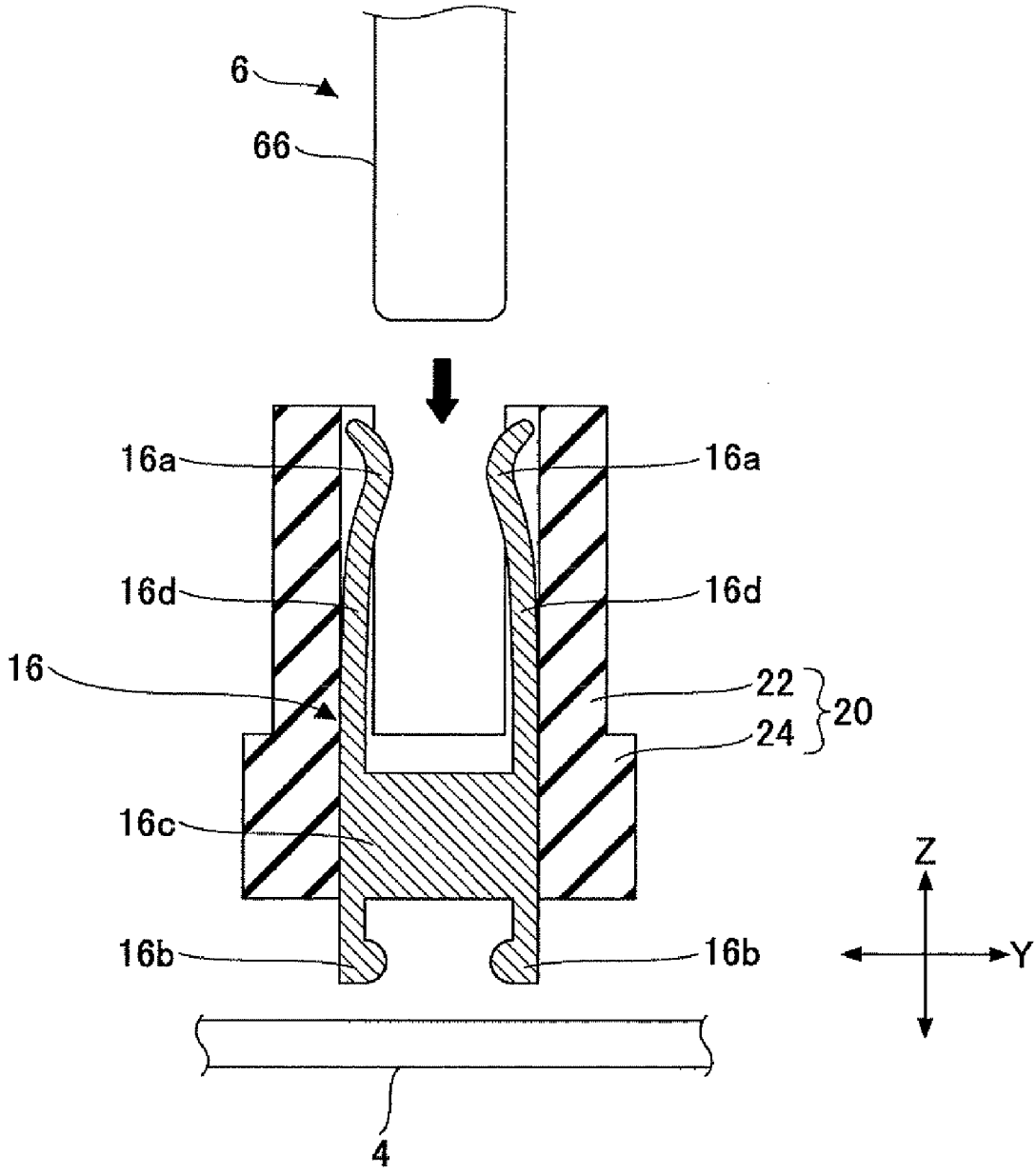
FIG. 3 is a cross-sectional view on arrows B-B, showing a connection mode between the balanced transmission connector 2 and the counterpart connector 6.

FIG. 1 is a perspective view showing an embodiment of a balanced transmission connector 2 of the present invention. FIG. 2 is a cross-sectional view on arrows A-A in FIG. 1, showing a connection mode between the balanced transmission connector 2 and a counterpart connector 6. FIG. 3 is a cross-sectional view on arrows B-B in FIG. 1, showing a connection mode between the balanced transmission connector 2 and the counterpart connector 6. In FIGS. 1 through 6, X, 1, and Z directions perpendicularly cross each other.

The balanced transmission connector is a device for electrically connecting electronic devices such as an electronic computer, a server, an exchange, and a computer. For example, the balanced transmission connector 2 is mounted on a circuit substrate 4 (see FIG. 2) and the counterpart connector 6 mounted on another circuit substrate (not shown) fits into the balanced transmission connector 2. When the counterpart connector 6 fits into the balanced transmission connector 2, the circuit substrate 4 and the circuit substrate on which the counterpart connector 6 is mounted are electrically connected to each other. The balanced transmission connector 2 may be, for example, a jack type connector as shown in FIG. 1 or a plug type connector.

The balanced transmission connector 2 includes, as shown in FIG. 1, plural pairs of signal contacts 10, plural ground contacts 16, and an insulator 20. Each of the pairs of signal contacts 10 is formed of a pair of signal contacts 12 and 14 (see FIG. 2) which face each other in a column direction (Y direction). The plural pairs of signal contacts 10 are arranged at a predetermined interval in a row direction (X direction). The plural ground contacts 16 are arranged one by one between the adjacent pairs 10 of signal contacts. The insulator 20 supports the plural signal contacts 12, 14, and the plural ground contacts 16 to be mutually insulated from each other.

The pairs of signal contacts 10 transmit signals having a waveform that is symmetrical about the horizontal axis (positive negative symmetrical waveform). The signal contacts 12 and 14 which constitute the pair of signal contacts 10 may be formed in substantially the same shape so that signal transmission times of them become the same. The pair of signal contacts 12 and 14 is formed by, for example, stamping and/or punching a conductive metal plate.

The signal contacts 12 and 14 have plate shapes as shown in FIG. 2. The signal contacts 12 and 14 have connecting parts 12*a* and 14*a* at ends in a longitudinal direction (Z direction), which are connected to counterpart signal contacts 62 and 64; mounting parts 12*b* and 14*b* at the other ends in the longitudinal direction, which are mounted on the circuit substrate 4; and fixing parts 12*c* and 14*c* fixed in the insulator 20 between the circuit substrate 4 and the counterpart signal contacts 62 and 64, respectively.

The connecting parts 12*a* and 14*a* are provided at leading ends of arm parts 12*d* and 14*d* extending in the longitudinal direction from the fixing parts 12*c* and 14*c*, respectively. Further, the mounting parts 12*b* and 14*b* are extended in the longitudinal direction from the fixing parts 12*c* and 14*c* to the circuit substrate 4. Furthermore, the fixing parts 12*c* and 14*c* are provided with locking claws (not shown) for preventing detachment on both side surfaces of the Y direction.

When the counterpart connector 6 fits into the balanced transmission connector 2, the signal contacts 12 and 14 and the counterpart signal contacts 62 and 64 are connected to each other. At this time, the connecting parts 12*a* and 14*a* are pressed in the directions (Y directions) opposite to each other, and thereby the arm parts 12*d* and 14*d* are elastically deformed (opened) by using the fixing parts 12*c* and 14*c* as bases. By a recovery force for countering this elastic deformation, the connecting parts 12*a* and 14*a* are securely connected to the counterpart signal contacts 62 and 64.

The ground contacts 16 prevent crosstalk between the adjacent pairs of signal contacts 10. In order to reliably prevent crosstalk, the ground contact 16 may have a larger shape than the pair of signal contacts 10. The ground contact 16 is formed by, for example, stamping and/or punching a conductive metal plate.

The ground contact 16 has a plate shape as shown in FIG. 3. The ground contact includes a pair of connecting parts 16*a* at ends in the longitudinal direction (Z direction), which are connected to a counterpart ground contact 66; a pair of mounting parts 16*b* provided at the other ends in the longitudinal direction, which are mounted on the circuit substrate 4; and a fixing part 16*c* fixed in the insulator 20 between the circuit substrate 4 and the counterpart ground contact 66.

The pair of connecting parts 16*a* is provided at leading ends of a pair of arm parts 16*d* which are dichotomously extended in the longitudinal direction from the fixing part 16*c*. The pair of mounting parts 16*b* is dichotomously extended in the longitudinal direction from the fixing part 16*c*. The fixing part 16*c* is provided with locking claws (not shown) for preventing detachment on both side surfaces of the Y direction.

When the counterpart connector 6 fits into the balanced transmission connector 2, the ground contact 16 and a counterpart ground contact 66 are connected to each other. At this time, the connecting parts 16*a* are pressed in the directions opposite to each other, and thereby the pair of arm parts 16*d* is elastically deformed (opened) by using the fixing part 16*c* as a base. By a recovery force for countering this elastic deformation, the pair of connecting parts 16*a* is securely connected to the counterpart signal contact 66.

Figure 4A:
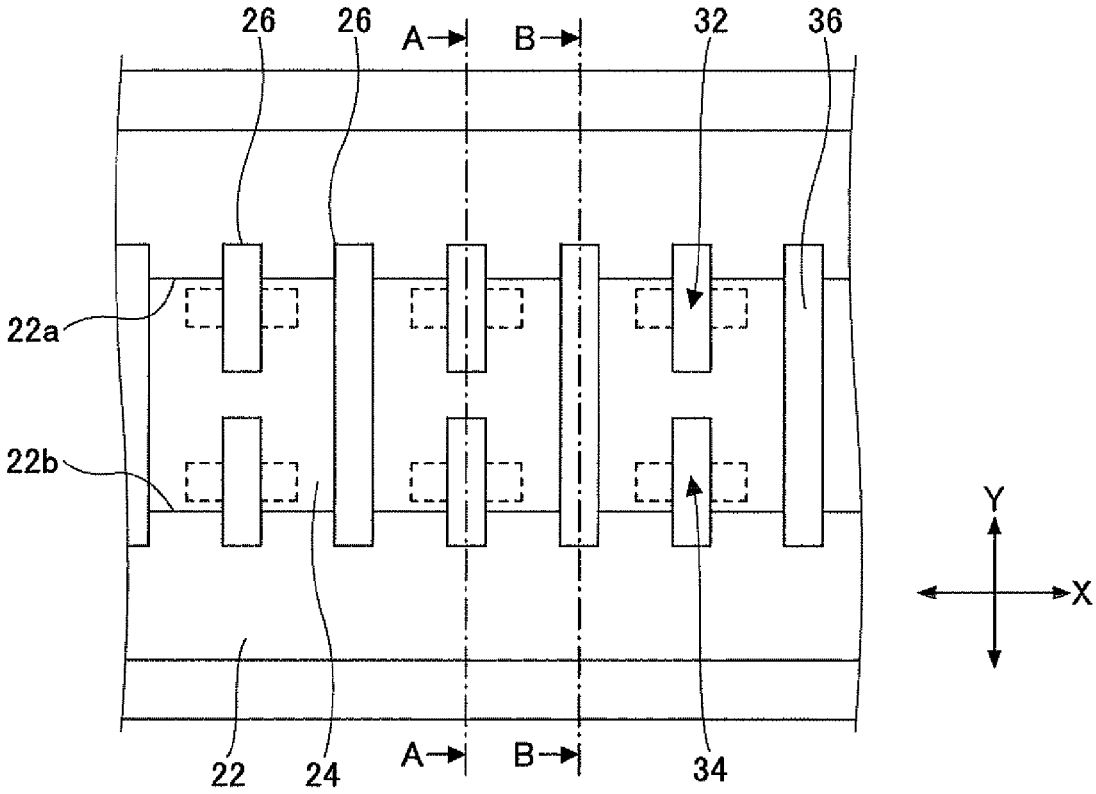
FIGS. 4A through 4C are schematic diagrams showing configurations of an insulator 20 shown in FIG. 1.
Figure 4B:
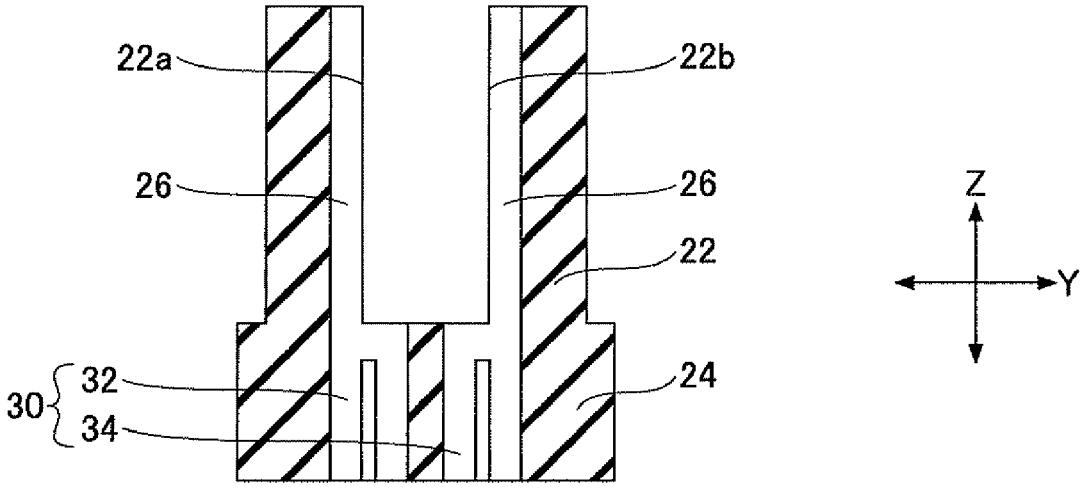
Figure 4C:
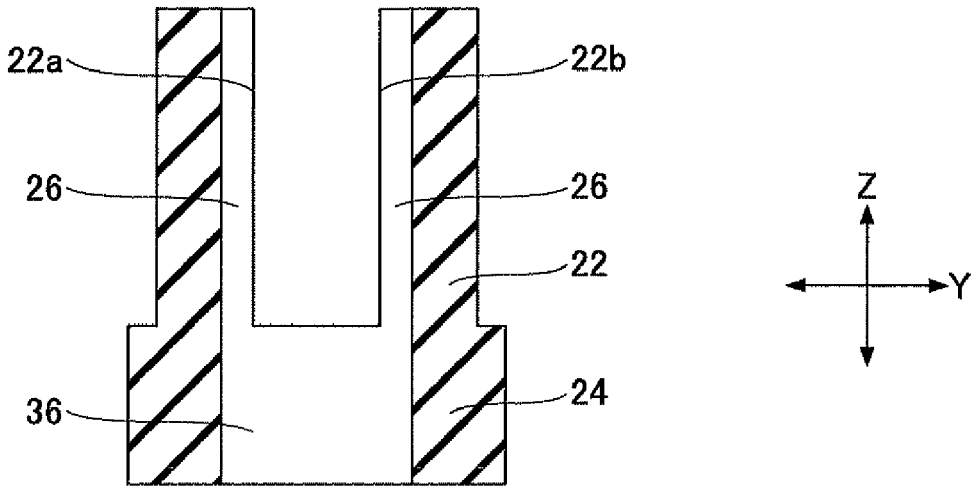

FIGS. 4A through 4C are schematic diagrams showing configurations of the insulator 20 in FIG. 1. FIG. 4A is a top view, FIG. 4B is a cross-sectional view on the arrows A-A in FIG. 4A, and FIG. 4C is a cross-sectional view on arrows B-B in FIG. 4A, of the insulator 20.

As shown in FIGS. 2 through 4C, the insulator 20 includes a fit part 22 into which the counterpart connector 6 detachably fits, and a supporting part 24 for supporting the plural signal contacts 12, 14, and the plural ground contacts 16.

As shown in FIGS. 4A through 4C, the fit part 22 has, for example, a quadrangular tubular shape into which the counterpart connector 6 detachably fits. In a pair of inner wall surfaces 22*a* and 22*b* which face each other in the column direction among the four inner walls of the fit part 22, plural groove parts 26 are formed at a predetermined interval along the row direction. The groove parts 26 are formed to have a cross-sectional shape that is linear in parallel with the row direction. In this embodiment, the "cross-sectional shape" is a shape of a cross-section taken perpendicular to the Z direction.

As shown in FIGS. 2 and 3, the arm parts 12*d*, 14*d*, and 16*d* of the corresponding contacts 12, 14, and 16 are elastically deformably installed in the groove parts 26. In this state, the connecting parts 12*a*, 14*a*, and 16*a* provided at the leading ends of the arm parts 12*d*, 14*d*, and 16*d*, respectively, protrude from the inner wall surfaces 22*a* and 22*b* inwardly of the fit part 22.

When the counterpart connector 6 is inserted in the Z direction into the fit part 22, the connecting parts 12*a* and 14*a* (pair of connecting parts 16*a*) are pressed in directions opposite to each other. As a result, the arm parts 12*d* and 14*d* (pair of connecting parts 16*a*) are elastically deformed (further separated) in the groove parts 26. In accordance with the deformation, the connecting parts 12*a* and 14*a* (pair of connecting parts 16*a*) move in directions in which they are forced into the inner wall surfaces 22*a* and 22*b*. In this manner, the counterpart connector 6 is inserted inside the fit part 22.

The supporting part 24 has, for example, a block shape as shown in FIGS. 4A through 4C. The supporting part 24 has plural pairs of fixing holes 30 and plural fixing holes 36 for ground contacts. The pair of fixing holes 30 is formed of a pair of fixing holes 32 and 34 for signal contacts, which face each other in the column direction. The plural pairs of fixing holes 30 are formed at a predetermined interval in the row direction. The plural fixing holes 36 for the ground contacts are formed one by one between the adjacent pairs of fixing holes 30.

Each of the fixing holes 32 and 34 for the signal contacts has, as its characteristic configuration, a part having a cross-section in a cruciform shape that is parallel to the column and row directions as shown in FIG. 4A. On the other hand, the fixing holes 36 for the ground contacts are each formed to have a cross-section in a linear shape that is parallel to the column direction.

As shown in FIG. 2, the fixing parts 12*c* and 14*c* of the signal contacts 12 and 14 are pressed to be fixed into the fixing holes 32 and 34 for the signal contacts. Further, the fixing part 16*c* of the ground contact 16 is pressed to be fixed into the fixing hole 36 for the ground contact as shown in FIG. 3.

Each of the fixing holes 32, 34, and 36 is continuously connected to the corresponding groove part 26 of the fit part 22, passing through the supporting part 24 in the Z direction. Therefore, when the contacts 12, 14, and 16 are inserted in the Z direction into the insulator 20, the corresponding fixing parts 12*c*, 14*c*, and 16*c* are pressed to be fixed into the fixing holes 32, 34, and 36. At the same time, the corresponding arm parts 12*d*, 14*d*, and 16*d* are elastically deformably forced into the groove parts 26. In this state, each of the contacts 12, 14, and 16 is supported to have a cross-sectional shape which is linear in parallel with the column direction.

Figure 5A:
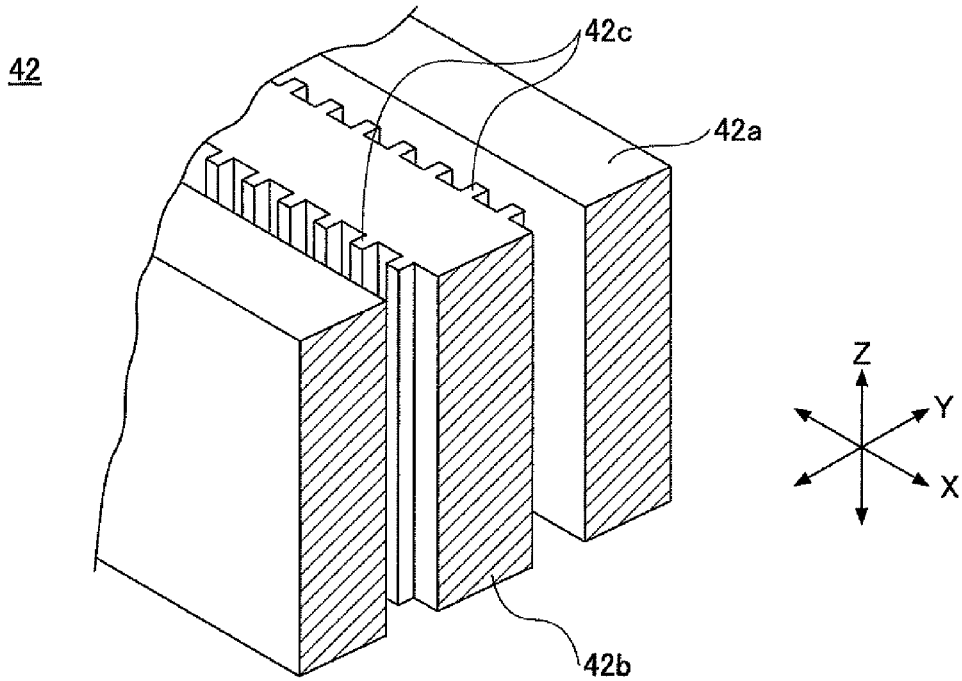
FIGS. 5A and 5B are partial cross-sectional views showing configurations of molds used for molding the insulator 20 shown in FIGS. 4A through 4C with resin.
Figure 5B:
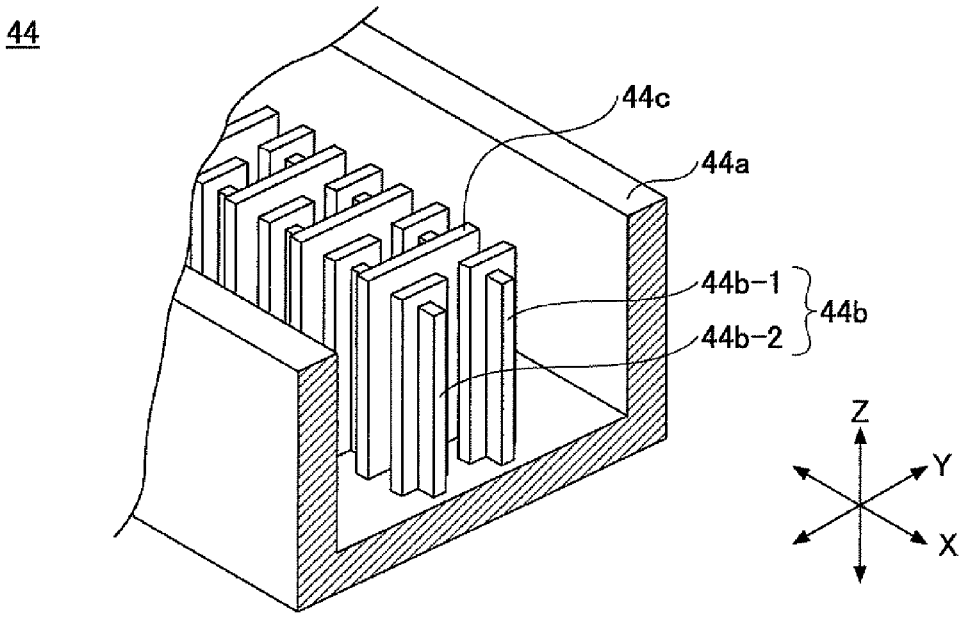

FIGS. 5A and 5B are partial cross-sectional views showing configurations of molds used for molding the insulator 20 shown in FIG. 4 with resin. FIG. 5A is a top view showing a configuration of a first mold 42, and FIG. 5B is a top view showing a configuration of a second mold 44. The mold used for the resin molding includes the first mold 42 and the second mold 44. The first mold 42 corresponds to the fit part 22 of the insulator 20, while the second mold 44 corresponds to the supporting part 24 of the insulator 20. The first and second molds 42 and 44 are assembled at divided surfaces to be used as a unit. By supplying a molten resin into the first and second molds 42 and 44 and thermally curing the resin, the fit part 22 and the supporting part 24 are molded as a unit.

As shown in FIG. 5A, the first mold 42 includes an outer frame 42*a* in a quadrangular tubular shape and a core 42*b* in a quadrangular prism shape. Among the peripheral four outer wall surfaces of the core 42*b*, outer wall surfaces which face each other in the column direction have plural ribs 42*c* provided in a protruding condition at a predetermined interval along the row direction.

The ribs 42*c* are provided for forming the groove parts 26. Each of the ribs 42*c* is extended to travel the length of the outer wall surface of the core 42*b* in the Z direction.

As shown in FIG. 5B, the second mold 44 includes a container 44*a* in a quadrangular tubular shape having a bottom. On a bottom surface of the container 44*a*, plural pairs of protrusions 44*b* and plural third protrusions 44*c* are implanted. Each of the pairs of protrusions 44*b* is formed of a first protrusion 44*b*-1 and a second protrusion 44*b*-2 that face each other in the column direction. The plural pairs of protrusions 44*b* are arranged at a predetermined interval in the row direction. The plural third protrusions 44*c* are arranged one by one between the adjacent pairs of protrusions 44*b*.

The protrusions 44*b*-1, 44*b*-2, and 44*c* are extended longitudinally in the Z direction in the container 44*a*, and are continuously connected to the corresponding ribs 42*c* when the first and second molds 42 and 44 are assembled to be attached at the divided surfaces.

The first and second protrusions 44*b*-1 and 44*b*-2 are provided for forming the fixing holes 32 and 34 for the signal contacts, which have parts having a cross section in a cruciform shape. Therefore, each of the first and second protrusions 44*b*-1 and 44*b*-2 is formed to have a part having a cross section in a cruciform shape that is parallel to the column and row directions, as shown in FIG. 5B. The first and second protrusions 44*b*-1 and 44*b*-2 each having a part with a cross section in a cruciform shape have higher strength compared to the conventional first and second protrusions each having a linear-shaped cross section (plate shape).

On the other hand, the third protrusions 44*c* are provided for forming the fixing holes 36 for the ground contacts 16 having linear-shaped cross sections in resin. Therefore, the third protrusions 44*c* are formed to have cross sections in linear shapes that are parallel to the column direction as shown in FIG. 5B.

In this manner, in the balanced transmission connector 2 of this embodiment, each of the fixing holes 32 and 34 for the signal contacts has a part having a cross section in the cruciform shape. Therefore, the strength of the part of the mold 44, which is used for molding the fixing holes 32 and 34 for the signal contacts, can be increased. Accordingly, the quality of the insulator 20 can be stabilized.

Figure 6A:
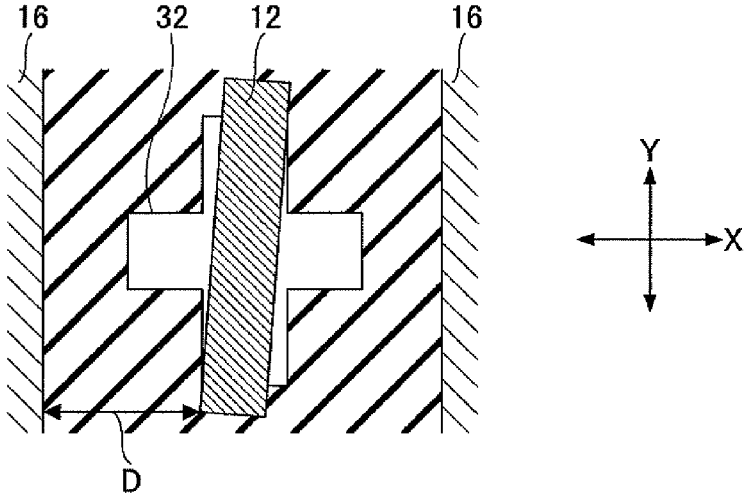
FIGS. 6A through 6C are cross-sectional views on arrows C-C, showing examples
Figure 6B:
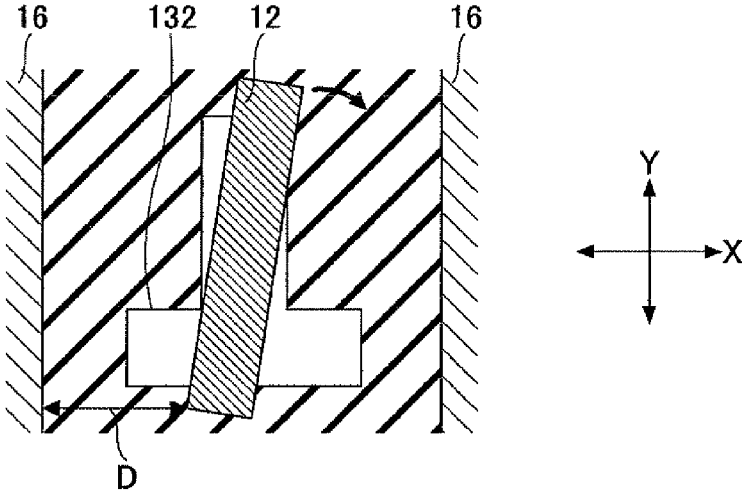
Figure 6C:
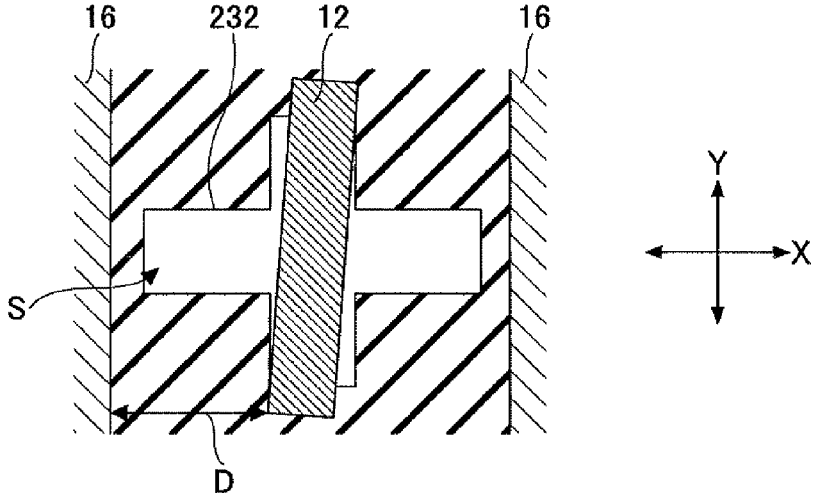

FIGS. 6A through 6C are cross-sectional views on arrows C-C in FIG. 1, showing examples of a signal contact 12 that is pressed to be fixed into the fixing hole for the signal contact 12. FIG. 6A is a cross-sectional view showing a case of this embodiment, FIG. 6B is a cross-sectional view showing a state of the conventional example, and FIG. 60 is a cross-sectional view showing a state of a deformation example of FIG. 6A. FIGS. 6A through 6C show examples where the signal contact 12 serving as one of the pair of signal contacts 10 is pressed to be fixed into the fixing hole 32 for the signal contact 12, which serves as one of the pair of fixing holes 30. Examples where the other signal contact 14 is pressed to be fixed into the other fixing hole 34 for the signal contact 14 are similar to those in FIGS. 6A through 6C; therefore, their drawings are omitted.

In this embodiment, as shown in FIG. 6A, the signal contact 12 having a linear-shaped cross section (plate shape) is pressed to be fixed into the fixing hole 32 for the signal contact 12, which has a part having a cross section in the cruciform shape. Therefore, movements of opposite ends of the signal contact 12 in the cross-sectional longitudinal directions (Y directions) are restricted, and the Z-axial rotation of the signal contact 12 is restricted as well. Accordingly, a distance D between the signal contact 12 and the ground contact 16 can be maintained, and thereby the impedance match can be maintained.

In the conventional example, on the other hand, the signal contact 12 having a linear-shaped cross section (plate shape) is pressed to be fixed into a fixing hole 132 for the signal contact 12, which has a T-shaped cross section, as shown in FIG. 6B (prior art). Therefore, there are cases where one end of the signal contact 12 in the cross-sectional longitudinal direction (Y direction) moves in the row direction and the signal contact 12 rotates Z-axially. Accordingly, there are cases where a distance D between the signal contact 12 and the ground contact 16 is changed and thus the impedance is changed. As a result, the impedance match is degraded in some cases.

In the deformation example shown in FIG. 6C, a fixing hole 232 is expanded in the row direction so that a space S existing between the signal contact 12 and the ground contact 16 is expanded in the row direction compared to this embodiment shown in FIG. 6A. Accordingly, the dielectric constant (relative dielectric constant) between the signal contact 12 and the ground contact 16 can be further reduced, and the impedance can be further increased. In the deformation example shown in FIG. 6C, the Z-axial rotation of the signal contact 12 is restricted and thus the impedance match can be maintained, in a manner similar to this embodiment shown in FIG. 6A.

In the conventional example shown in FIG. 6B (prior art), on the other hand, if the space S existing between the signal contact 12 and the ground contact 16 is expanded in the row direction, there are cases where the signal contact 12 further rotates about the Z-axis and the distance D between the signal contact 12 and the ground contact 16 is changed. Therefore, there are cases where the impedance is changed and thus the impedance match is further degraded.

As described above, according to the balanced transmission connector 2 of this embodiment, at least a part of each of the fixing holes 32 and 34 for the signal contacts has a cross section in a cruciform shape. Therefore, rotations about the Z-axis of the signal contacts 12 and 14 each having a linear-shaped cross section (plate shape) can be restricted. Accordingly, the distance D between the ground contact 16 and each of the signal contacts 12 and 14 can be maintained, and thereby the impedance match can be maintained as well.

Further, since each of the fixing holes 32 and 34 for the signal contacts has at least a part having a cross section in the cruciform shape, the axial rotations of the signal contacts 12 and 14 each having the linear-shaped cross section can be restricted. At the same time, the space S existing between the ground contact 16 and each of the signal contacts 12 and 14 can be expanded in the row direction. Accordingly, the dielectric constant (relative dielectric constant) between the ground contact 16 and the signal contacts 12 and 14 can be decreased, and thereby the impedance can be further increased.

Although the present invention has been described with respect to a specific embodiment for a complete and clear disclosure, the appended claims are not to be thus limited but are to be construed as embodying all modifications and alternative constructions that may occur to one skilled in the art that fairly fall within the basic teachings herein set forth.

For example, the connector 2 includes the plural ground contacts 16 and plural fixing holes 36 for the ground contacts in the above embodiment, but the present invention is not limited to this. For example, the connector 2 of the present invention does not have to include the plural ground contacts 16 and the plural fixing holes 36 for the ground contacts.

In this case, since each of the fixing holes 32 and 34 for the signal contacts has at least a part having a cross section in the cruciform shape, the strength of a part of the second mold 44, which is used for molding the fixing holes 32 and 34 for the signal contacts, can be enhanced. Accordingly, the quality of the insulator 20 can be stabilized.

Further, since the fixing hole 32 for the signal contact has at least a part having a cross section in the cruciform shape in this case, the axial rotation of the signal contact 12 having the linear-shaped cross section (plate shape) can be restricted. Accordingly, the distance between the adjacent pairs of signal contacts 10 can be maintained, and thereby the impedance match can be maintained as well.

Further, since the fixing hole 32 for the signal contact has at least a part having a cross section in the cruciform shape in this case, the space S existing around the signal contact 12 can be expanded in the row direction. Accordingly, the dielectric constant (relative dielectric constant) around the signal contact 12 can be decreased, and thereby the impedance can further be increased.

Further, in the above embodiment, the fixing hole 36 for the ground contact is formed to have a cross section in the linear shape that is parallel to the column direction; however, the present invention is not limited to this. For example, the fixing hole 36 for the ground contact may be formed so that at least a part of it has a cross section in a cruciform shape that is parallel to the row and column directions.

In this case, each of the third protrusions 44*c* for molding the fixing holes 36 for the ground contacts in the resin is formed so that at least a part of it has a cross section in a cruciform shape that is parallel to the row and column directions. Therefore, the strength of a part of the mold 44, which is used for molding the fixing holes 36 for the ground contacts 16 in the resin, can be enhanced, and the quality of the insulator 20 can be stabilized.

According to one embodiment, a connector which has a configuration capable of stabilizing the quality of the insulator and can maintain the impedance match, and a manufacturing method of the connector can be provided.

This patent application is based on Japanese Priority Patent Application No. 2009-043903 filed on Feb. 26, 2009, the entire contents of which are hereby incorporated herein by reference.

What is claimed is:

1. A connector comprising:

a plate-shaped signal contact configured to transmit a signal; and an insulator including a fixing hole into which the signal contact is pressed to be fixed, wherein at least a part of the fixing hole has a cross section in a cruciform shape;

the insulator further includes a lower portion, and an upper portion provided on the lower portion, the signal contact penetrating the lower portion and the upper portion through the fixing hole so that the signal contact contacts a counterpart connector only at the upper portion; and the part of the fixing hole having the cross section in the cruciform shape is located only in the lower portion.

2. A balanced transmission connector comprising:

an insulator formed of resin and having a plurality of fixing holes arranged in a line;

a plurality of plate-shaped metal signal contacts configured to transmit signals; and a plurality of plate-shaped metal ground contacts, wherein the plurality of plate-shaped metal signal contacts and the plurality of plate-shaped metal ground contacts are pressed to be fixed into the plurality of fixing holes of the insulator so as to be alternately arranged with each other;

each of the plurality of the fixing holes in which the plurality of the plate-shaped metal signal contacts are fixed has at least a part having a cross section in a cruciform shape;

the insulator includes a lower portion, and an upper portion provided on the lower portion, the signal contact penetrating the lower portion and the upper portion through the fixing hole so that the signal contact contacts a counterpart connector only at the upper portion; and the part of the fixing hole having the cross section in the cruciform shape is located only in the lower portion.

3. A manufacturing method of a connector, comprising:

molding an insulator with a resin by using a mold having a protrusion on a bottom surface for forming a fixing hole in the insulator, at least a part of the protrusion having a cross section in a cruciform shape, and pressing a plate-shaped signal contact configured to transmit a signal to be fixed into the fixing hole having a cross section in a cruciform shape, wherein the insulator includes a lower portion, and an upper portion provided on the lower portion, the signal contact penetrating the lower portion and the upper portion through the fixing hole so that the signal contact contacts a counterpart connector only at the upper portion; and the part of the fixing hole having the cross section in the cruciform shape is located only in the lower portion.

* * * * *